United States Patent [19]

Sauder

[11] 4,195,454

[45] Apr. 1, 1980

[54] ROOF STRUCTURE

[76] Inventor: Reinhold Sauder, 7315 8th Ave., Regina, Saskatchewan, Canada

[21] Appl. No.: 904,898

[22] Filed: May 11, 1978

[51] Int. Cl.[2] ..... E04B 7/04

[52] U.S. Cl. ..... 52/92; 52/262; 52/539; 52/580; 52/780

[58] Field of Search ..... 52/86, 92, 262, 539, 52/580, 780, 823

[56] References Cited

U.S. PATENT DOCUMENTS

| | | | |
|---|---|---|---|
| 143,352 | 9/1873 | Johnson et al. | 52/474 |
| 176,446 | 4/1876 | Shepard | 52/278 X |
| 451,733 | 5/1891 | Leonard | 52/780 |
| 602,194 | 4/1898 | Pease | 52/799 |
| 1,817,619 | 8/1931 | Greenwald | 52/86 |
| 2,264,546 | 12/1941 | Ochs | 52/54 |
| 2,397,388 | 3/1946 | Troedsson | 52/262 |
| 3,256,653 | 6/1966 | Huff | 52/89 |
| 3,277,621 | 10/1966 | Merdich | 52/86 |
| 3,464,168 | 9/1969 | Russell et al. | 52/63 |
| 3,648,420 | 3/1972 | Nelson | 52/86 |
| 3,975,876 | 8/1976 | Sauder | 52/780 |

FOREIGN PATENT DOCUMENTS

| | | | |
|---|---|---|---|
| 255024 | 1/1949 | Switzerland | 52/86 |

*Primary Examiner*—Alfred C. Perham

*Attorney, Agent, or Firm*—Stevens, Davis, Miller & Mosher

[57] ABSTRACT

A roof structure of the type having a plurality of wooden beams whose sides are provided with mortices for receiving end edges of roofing panels. The invention improves the strength of the structure by employing a generally zig-zag or corrugated cross-section by arranging the mortices such that at least a major portion of each mortice extends at an acute angle with respect to the elongation of the beam, which generally corresponds to the direction of wood grain. The invention thus provides the advance of an increased strength of the structure as compared with prior art which is typical by the mortices being generally straight and/or parallel with the elongation of the wood grain which normally corresponds to the elongation of the beam.

5 Claims, 6 Drawing Figures

Fig. 1
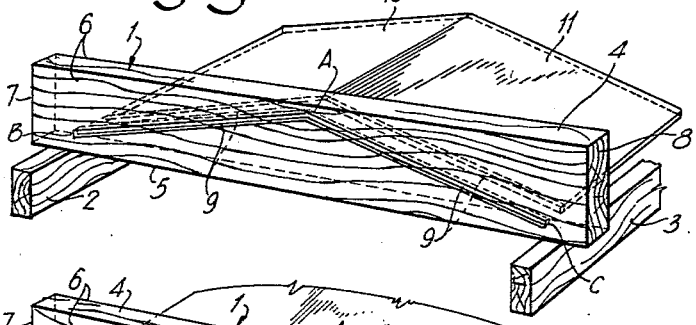
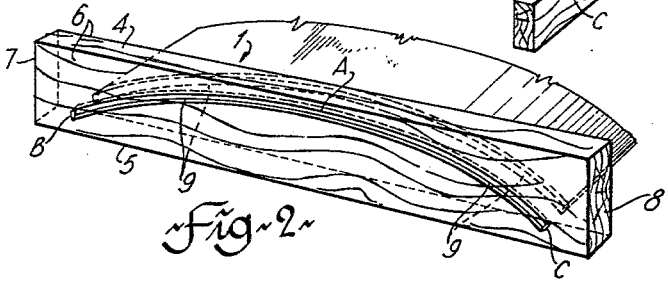
Fig. 2
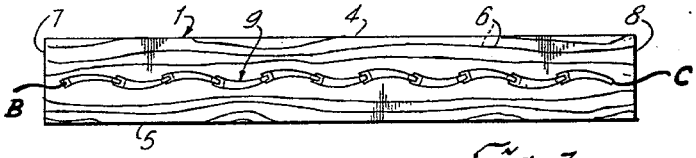
Fig. 3
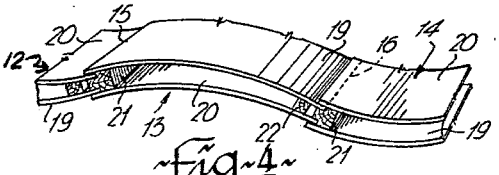
Fig. 4
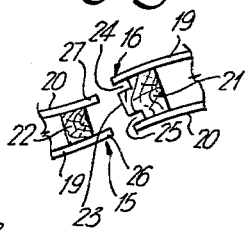
Fig. 5
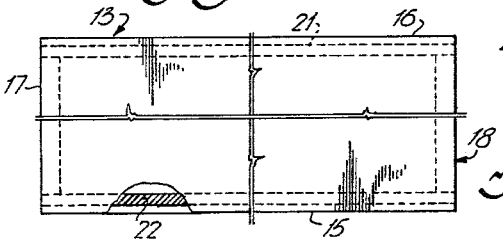
Fig. 6

ROOF STRUCTURE

The present invention relates to a roof structure of the type comprising a plurality of wooden beams with roofing panels received in grooves or mortices provided in the sides of such roof beams.

The roof structure of the above type have long been known, an example of such structure being, for instance, U.S. Pat. No. 176,446 (Shepard) or U.S. Pat. No. 451,733 (Leonard). The drawback of the known structures of this type is that their mortices or grooves extending generally parallel with the elongation of the beams produce a generally flat roof surface and as such have relatively low strength.

It is an object of the present invention to overcome the above drawback and to provide a novel roof structure of the above type, particularly for prefabricated structures, in which the roofing boards and the beams interact to improve the overall strength of the roof.

It is an object of the present invention to overcome the above drawback and to provide a novel roof structure of the above type in which the maximum strength inherent to the material is utilized in an improved manner.

According to the invention, a roof structure is provided of the type including a plurality of elongated, generally rectangular wooden beam members, each having a top face, a bottom face, two side faces and two end faces, with longitudinal channel means in at least one of said side faces. The channel means receives an edge portion of a roofing panel member. At least a major portion of the channel means extends at an acute angle with respect to the elongation of said beam member. The channel means includes terminal abutment means, preferably of the type of termination of the groove. The terminal abutment means is arranged in proximity of the end faces of the beam member. The channel means preferably terminates at points spaced from the end faces of the beam member, whereby the ends of the channel means form the terminal abutment means. The shape of the groove in the side faces of the beams is preferably in the shape of an inverted V, of an arc or of a wavy line. The invention also provides a combination of the beams provided with the wavy line with a plurality of identical roofing panels having two side edges, two end edges and surface means extending between the edges to form the surface of the panel. The end edges of each of the panels are curved to generally correspond to the shape of at least a portion of the length of the respective wavy groove in the supporting beam. The side edges of the roofing panels are generally straight and extend between respective ends of the panel, whereby the surface means is of a concavo-convex shape corresponding to the shape of the wavy groove.

The invention will now be described by way of several embodiments with reference to the accompanying drawings.

In the drawings:

FIG. 1 is a schematic, extremely simplified perspective view of a part of roof structure including one embodiment of the present invention, the figure being intended to be merely indicative of the basic principle of the invention;

FIG. 2 is a view similar to that of FIG. 1 but showing another embodiment of the present invention, this figure also being intended to be merely indicative of another embodiment of the basic principle of the present invention;

FIG. 3 is a partial view similar to that of FIG. 1 or FIG. 2 but showing a sloping roof beam for use in a further embodiment of the present invention;

FIG. 4 is a detailed perspective view, partly in section, of roofing panels for use in the embodiment of the present invention to which FIG. 3 pertains;

FIG. 5 is a detail of FIG. 4 showing the joinder of two adjacent panels thereof; and FIG. 6 is a schematic plan view of a roofing panel for use in the embodiment of the present invention shown in FIG. 4.

The corresponding parts of the members shown in the drawing are referred to with the same reference numerals, even though they may relate to different embodiments.

Turning firstly to FIG. 1, it is to be pointed out that this figure includes the simplest form of the present invention. The figure shows a part of a roof structure of the type including a plurality of elongated, generally rectangular wooden beams 1 (only two such beams being shown for the sake of clarity). The beams rest on two supporting beams 2, 3, normally forming a part of the walls of a building (not shown). The beam 1 is a heavy wooden beam of ordinary, straight, linear design such as 4"×16" and of the length as required by the span between the supporting beams 2, 3 and by engineering structural standards. It is to be appreciated, however, that the beam 1, together with beams 2 or 3, can also be of a laminated design or the like. The beam 1 has a top face 4, a bottom face 5, two side faces 6 and two end faces 7, 8. Both side faces 6 are provided with a mortice or groove 9, also referred to in general terms as "longitudinal channel means".

The groove 9 has the shape of a flat, inverted V, generally defined by an apex point A and by two terminal points B, C. The groove 9 receives edge portions of roofing panel members 10, 11 which, in the embodiment of FIG. 1, are generally identical rectangular panels of plywood.

For the sake of clarity, the panels 10, 11 in FIG. 1 are only shown as extending from the side face 6 turned away from the plane of the view of FIG. 1, whereas the face 6 turned towards the viewer of FIG. 1 is shown free of such panels.

As mentioned above, the beam 1 is a regular wooden beam, either made of a single piece wood or laminated. In other words, the wood grain in such beam extends generally longitudinally thereof, i.e. in a direction from the end face 7 towards the end face 8, generally parallel with the top and bottom faces 4, 5. With respect to the groove 9, it will be observed that both its portions A–B and A–C deviate from the general direction of the wood grain in that each of the portions AB and AC is inclined with respect to wood grain of the beam at an acute angle. This particular structural feature is further combined with the groove 9 actually terminating at points B, C which are each spaced from the respective end walls 7, 8. The termination points B, C are selected such that they actually abut against the ends of edges of panels 10, 11 received in the respective portions of the groove 9. In general terms, the ends of groove 9 at points B, C represent one embodiment of what can generally be referred to as "abutment means in proximity of the end faces 7, 8 of the beam member 1". It will be appreciated that all of the shown embodiments of the groove 9 terminate at points B, C which are spaced from the associated end top face and bottom face of the respective beam 1. The ends B, C of the groove 9 of the embodiment of FIGS. 1 and 2 terminate in proximity to the end faces 7, 8 and near the bottom face 5. The apex portion of the embodiments of FIGS. 1 and 2, marked with letter A, is located in the center of the overall length of beam 1 and is near the top face 4 thereof. The ends B, C of the groove 9 (FIG. 1, FIG. 2) are each located above the end portions of the bottom face 5 of the respective beam 1 such that the portion of the bottom face closest to the respective end B, C rests on the respective top face of supporting beam 2, 3. The support beams 2, 3 in FIGS. 1 and 2 maintain the respective beams 1 in a generally horizontal position.

On the other hand, the beam 1 as shown in FIG. 3 is used in a sloping roof structure (the corresponding beams and roofing panels not being shown in FIG. 3 for the sake of clarity). The beam of FIG. 3 is designated for use in a still further embodiment of the present invention differing from the aforementioned embodiments of FIGS. 1 and 2 particularly in the shape of the groove 9. The groove 9 of the embodiments of FIG. 3 is of a wavy or sinusoid configuration and extends generally centrally of the respective side faces 6 of beam 1. Thus, although the terminal points B, C are closely spaced from the respective end faces, they terminate approximately midway between the top and bottom faces 4, 5 of the beam 1. It will be appreciated that the wavy groove 9 of the embodiment in FIG. 3 also meets the requirement of at least its major portion extending at an acute angle with respect to the elongation of the beam member 1, such acute angle, of course, being the angle of a tangent to the wavy line at respective points of the locus thereof.

The wavy groove 9 of the beam as shown in FIG. 3 is of a particular cross section which differs from the generally uniform cross section of the embodiments of FIGS. 1 and 2, due to the use in the embodiment of FIG. 3 of a plurality of special roofing panels which are shown in a partial perspective view of FIG. 4 and which will now be described in greater detail. FIG. 4 shows three interlocked panels 12, 13 and 14, the panels being of identical shape and size. Each of the panels has two side edges 15, 16 and two end edges 17, 18 (see FIG. 6), the latter being normally received in the respective grooves 9 of the beams 1 such as shown in FIG. 3. The presence of panels 12, 13, 14, etc. in the groove 9 of the beam of FIG. 3 is schematically indicated by schematically showing the position of the side edges of the respective panels.

With particular reference to panel 13 of FIG. 4, it will be observed that the panel includes a top plywood board 19 and a bottom plywood board 20, the boards being fixedly secured to a frame of the panel 13. The frame includes arcuate end members (cut away in the view of FIG. 4) which are normally coincident with the end edges 17, 18 of the panel 13. The side edges 15, 16 of the panel 13, on the other hand, are straight and are coincident with side frame members 21, 22. The side frame members 21, 22 form the actual edge of the panel 13 and can therefore also be referred to as "side edges". Each of the panels thus has a concavo-convex surface which corresponds in section to the shape of groove 9 of beam 1 as shown in FIG. 3. In the embodiment of FIG. 4 the concave surface is formed by the board 20 while the convex surface is that of the board 19. Those skilled in the art will readily appreciate that this is the preferred embodiment of the panels as shown in FIG. 4 even though a generally S-shaped cross section of the panel 13 can also be contemplated but would be somewhat more expensive to produce.

It will be observed from FIG. 4 that the thickness of panel 13 gradually decreases in the direction from one side edge to the other side edge, i.e. in the direction from the side frame member 21 towards the side frame member 22.

As best seen from FIG. 5, the side edges of the panel 13 include tongue-2nd-groove abutment means for interlocking of adjacent panels. In particular, the spacing of the boards 19, 20 at the side member 21 is such as to generally correspond to the outside spacing beween the respective boards 19, 20 of the adjacent panel. Moreover, the side frame member 21 is provided with a tongue protrusion 23. With the boards 19, 20 overlapping the adjacent part of the side frame member 21, two grooves 24, 25 are formed between the respective boards 19, 20 and the sides of the tongue protrusion 23. On the other hand, the end edges of boards 20, 21 overlap the side frame member 22 to form, in effect, two tongues 26, 27 which can be received in the grooves 25, 24, respectively. Two adjacent panels 12, 13 or 13, 14 can thus be positively engaged with each other, the abutment joinder being of the type of tongue-and-groove means. As best seen from the locus of groove 3 and from the mutual arrangement of the panels in FIG. 4, the panels are arranged such that an upwardly arched panel abuts against a downwardly arched which, in turn, engages with a further upwardly arched panel, etc.

The panels as described above are, of course, identical and may be of a standard 4 ft. width and 8, 12, 16, 20 or 24 feet in length, depending on the requirements.

The most significant advantage of the present invention can be appreciated on examining the embodiment of FIG. 1. The roof beam 1 is supported by beams 2 and 3 at its outer extremities B, C. Without the panels 10, 11 in place, the workload or deadload carried by the beam is transmitted vertically from the top face 4 through to the bottom edge of the beam directly at and along every portion of the beam. The lower half portion of the beam acts as a tensor. In other words, it is under tension by the force of the load. The upper half portion of the beam, on the other hand, acts as a compression force of the load inflicted on it. This can be appreciated when realizing that the wood fibers making up the wood beam are long and tenuous like a miriad of tiny cables or strings packed tightly together in one mass that is cohesive in its structure, with the fibers oriented generally parallel to the elongation of the beam. Upon inserting wood panels 10, 11 in the respective portions of groove 9, the transfer factor of the load on the beam is changed so that any load placed on the top face 4 of the beam at any point or points between B and C are transmitted vertically down until they reach the panel 10 or 11 and from there the forces are transmitted along A, B or A, C to points B, C located directly over the support walls. The present invention therefore is able to transfer vertical load situated intermediately of the building frame members to the outer extremities of the structure onto the bearing walls. In other words, the present invention utilizes the maximum strength inherent to the wood material of which the structure is composed. In effect, the invention results in longer span of roofing beams such as beam 1.

Those skilled in the art will readily conceive further embodiments of a roof structure differing from those disclosed above. For instance, the representations of FIGS. 1 and 2 are to be viewed as means to aid the understanding of the basic principles of the present invention rather than actual preferred embodiments as the actual structure would normally have several zig-zag or wavy configurations of the boards (as in FIG. 3) rather than merely one or two roof panels as shown in FIGS. 2 and 1, respectively. Thus, there are further embodiments differing to a greater or lesser degree from the aforesaid disclosure but still falling within the scope of the present invention.

The embodiments of the invention in which an exclusive property or privilege is claimed are defined as follows:

1. A roof structure of the type including a plurality of elongated, generally rectangular wooden beam members each having a top face, a bottom face, two side faces and two end faces, longitudinal channel means in at least one of said side faces for receiving an end edge portion of a roofing panel member, at least a major portion of the length of said channel means extending at an acute angle with respect to the elongation of said beam member, said channel means being of the type of a wavy groove extending generally centrally and longitudinally of the respective side face of the beam member, said structure further comprising a plurality of generally identical roofing panels each having two side edges and two end edges, said end edges being received in said channel means; each of said roofing panels further having surface means extending between said edges to form the surface of said panel; said end edges of each of said panels being curved to generally correspond to the shape of at least a portion of the length of the respective wavy groove, said side edges being generally straight and extending between respective ends of said end edges, whereby said surface means is of a convaco-convex shape, wherein each of said panels gradually decreases in thickness in the direction from one of said side edges to the other, whereby the thickness of one side edge is less that that that of the other, the shape of said channel means being generally complementary with the shape of said plurality of the roofing panels at the respective end edges thereof.

2. A structure as claimed in claim 1 wherein said side edges of each panel include tongue-and-groove means for engaging side edges of adjacent panels to form a side joints of adjacent panels.

3. A structure as claimed in claim 2 wherein the thickness of side edge of one panel forming said joint is greater than the thickness of the side edge of the other panel forming said joint.

4. A structure as claimed in claim 3 wherein the length of the end edges of each of said panels in such that the overall length of the associated end edges of two abutted panels corresponds to one crest-and-valley portion of said wavy shape of the groove.

5. A structure as claimed in claim 4 wherein each of said panels is formed by a wooden frame including side edge members, arched end edge members, by a plywood top wall member and by a plywood bottom wall member, said wall members being fixedly secured to said wooden frame, said top wall member and said bottom wall member extending over the respective side edge members of said frame to form a portion of said tongue-and-groove means.

* * * * *